United States Patent [19]

Samuels

[11] 4,385,467

[45] May 31, 1983

[54] PHYSIOGNOMICALLY BASED PUZZLE TOY

[76] Inventor: Stephen S. Samuels, 28 Lower Alcatraz Pl., Mill Valley, Calif. 94941

[21] Appl. No.: 238,351

[22] Filed: Mar. 6, 1981

Related U.S. Application Data

[63] Continuation-in-part of Ser. No. 136,125, Mar. 31, 1980, Pat. No. 4,259,804.

[51] Int. Cl.[3] ..... A63H 33/06

[52] U.S. Cl. ..... 46/16; 273/157 R

[58] Field of Search ..... 46/16, 17, 22, 30; 273/157 R, 157 A

[56] References Cited

U.S. PATENT DOCUMENTS

| | | | |
|---|---|---|---|
| D. 156,338 | 12/1949 | Holcomb | D34/15 |
| 1,209,440 | 12/1916 | Humbert | 46/22 |
| 1,525,103 | 2/1925 | Orr . | |
| 2,280,609 | 4/1942 | Williamson | 273/157 R |
| 3,238,645 | 3/1966 | Wilson | 35/72 |
| 3,464,145 | 9/1969 | Martin | 46/17 |
| 3,637,217 | 1/1972 | Kent | 273/157 R |
| 3,739,730 | 6/1973 | Horowitz | 46/24 UX |
| 3,879,861 | 4/1975 | Grantham | 273/157 R X |
| 3,986,293 | 10/1976 | Rieur | 46/16 |
| 4,052,074 | 10/1977 | Fogle et al. | 273/157 R |

FOREIGN PATENT DOCUMENTS

| | | | |
|---|---|---|---|
| 87105 | 1/1922 | Austria | 46/22 |
| 870511 | 3/1953 | Fed. Rep. of Germany | 46/24 |
| 2238318 | 2/1973 | Fed. Rep. of Germany | 46/24 |
| 995270 | 8/1951 | France | 273/157 |
| 1001145 | 10/1951 | France | 46/16 |
| 319974 | 4/1957 | Switzerland | 273/157 R |

*Primary Examiner*—F. Barry Shay

*Attorney, Agent, or Firm*—Townsend and Townsend

[57] ABSTRACT

A multi-layered puzzle toy wherein each layer has a plurality of elements confined within a uniform ovoid peripheral contour, with elements being interchangeable and reversibly interchangeable with other elements in the same layer and other layers. The elements of each layer have contrasting opposite surfaces so that within a given layer elements may be reversed to fit in corresponding area portions that provide contrast in the appearance of the layer when filled with its elements. Within the ovoid contour are elements capable of forming a contrasting nose, mouth, and eyes of a stylized face with there being a sufficient multiplicity of elements in the region of the nose, mouth, and eyes to allow at least one of these facial features to be changed in position or shape to permit variations in the facial expression depicted. Moreover, the elements may be rearranged and selectively reversed within a layer to form an abstract asymmetrical configuration that is reminiscent but not directly representative of a stylized face. Each layer is preferably provided with one or more areas, filled by a first group of elements in that layer, that may be filled by a second group of elements in another layer wherein the individual elements of the second group have different peripheral configurations, differing in either size or shape.

23 Claims, 24 Drawing Figures

PHYSIOGNOMICALLY BASED PUZZLE TOY

FIELD OF THE INVENTION AND RELATED APPLICATIONS

The present invention relates generally to educational toys, and more specifically to puzzles having a plurality of elements that may be combined in many ways. This application is a continuation-in-part of copending U.S. application Ser. No. 136,125, filed Mar. 31, 1980, now U.S. Pat. No. 4,259,804, issued Apr. 7, 1981.

BACKGROUND OF THE INVENTION

"The range of facial expressions is as infinite as the range of human experience." —Anon.

The face is said to mirror the mind, and with rare exceptions such as expert poker players and catatonics, a person's facial expression provides a wealth of information regarding that person's emotional state and mental processes. One need only witness the response of a parent to his or her infant's smile to realize that facial expressions form a key element of human interaction throughout a person's entire life. The infant gains an increased sense of self-awareness as he emulates other people's facial expressions and notes the responses.

In recognition of the fact that facial expressions remain a fascinating part of a child's experience, there have been developed a number of children's toys based on the ability to construct a variety of facial expressions. For example, U.S. Pat. Nos. 1,525,103 and 156,338 disclose rectangular blocks having various facial features imprinted on their surfaces so that a user, by juxtaposing blocks having indicia corresponding to particular features, can construct a wide variety of faces. The interest in faces is not restricted to young children, and U.S. Pat. No. 3,879,861 which shows a character analysis educational game wherein a wide variety of faces may be built up from a stock of noses, mouths, chins, etc. This modular concept of facial construction also forms the basis of the police artist identification kit and the child's "potato head" games.

With respect to these various toys, placement of the movable elements is generally dictated by the unambiguous nature of the facial portion represented on the block or playing piece. By providing enough variations on each facial feature being depicted, a rather large variety of possible human faces may be formed. However, the parts tend to fit together in an unambiguous fashion. Thus, when a user tires of rearranging the same kind of pieces in the same kind of ways, albeit to get a variety of faces, the game or toy has lost its appeal. The key to a toy's long term success is its ability to maintain the interest of the user as the user gains more experience with the toy. This in effect presents a dual requirement since unless a beginner can quickly master the basic rudiments of the toy's operation, he is likely to become discouraged and abandon efforts to improve his level of skill. In such a case, the toy can scarcely be said to have universal appeal. Conversely, a toy that is capable of a limited number of arrangements, or perhaps mere variations on a single theme, fails to hold the interest of the user for more than a short period of time.

Jigsaw puzzles are well known for providing users of all ages with gratification and challenge in the areas of geometrical and pictorial relationships. However, given that a jigsaw puzzle can only be assembled in one way, a given jigsaw puzzle is generally addressed to users at a particular level of skill. An alternate but related approach is to construct a puzzle whose pieces can fit together many ways, thus allowing young people to at least assemble the puzzle, while providing additional challenge and variety by having the pieces marked to produce designs of varying degrees of intricacy. U.S. Pat. Nos. 3,637,217 and 3,986,293 disclose puzzle block toys wherein certain areas may be filled in by different subsets of elements in order to form a wide variety of intricate geometric patterns. If such puzzle toys can be said to have a weakness, it is the fact that many people do not find geometrical designs particularly interesting, being "more interested in people than things."

SUMMARY OF THE INVENTION

The present invention provides a puzzle toy that not only provides the user with stimulation and enjoyment as he works with concepts such as symmetry, geometric interchangeability, and color composition, but also transcends merely geometrical considerations by exposing him to and challenging him with physiognomic aspects at varying levels of abstraction.

Broadly, the present invention is a multi-layered puzzle wherein each layer has a plurality of elements confined within a uniform ovoid peripheral contour, with elements being interchangeable and reversibly interchangeable with other elements in the same layer and other layers. The elements of each layer have contrasting opposite surfaces so that within a given layer elements may be reversed to fit in corresponding area portions that provide contrast in the appearance of the layer when filled with its elements. Within the ovoid contour are elements capable of forming a contrasting nose, mouth, and eyes of a stylized face with there being a sufficient multiplicity of elements in the region of the nose, mouth, and eyes to allow at least one of these facial features to be changed in position or shape to permit variations in the facial expression depicted. Moreover, the elements may be rearranged and selectively reversed within a layer to form an abstract asymmetrical configuration that is reminiscent but not directly representative of a stylized face. This may be done at virtually any level of abstraction, thus allowing the user to experiment with such concepts as forced perception and threshold of recognition.

The breadth and depth of the operation of the present invention may be measurably increased by interchanging elements and groups of elements between layers. In particular, each layer is preferably provided with one or more areas, filled by a first group of elements in that layer, that may be filled by a second group of elements in another layer wherein the individual elements of the second group have different peripheral configurations, differing in either size or shape. By providing each layer with a different pair of contrasting surfaces, a further dimension is added to the already considerable variety of configurations that may be achieved.

According to a further aspect of the present invention, each element is of composite construction and includes removably fastened opposing portions to provide the contrasting opposite surfaces. In an embodiment where elements are molded from plastic, the portions are provided with complementary locking members that permit the portions to be snapped together. This provides additional flexibility, since it is possible to disassemble and reassemble elements in order to achieve additional combinations. For example, within a given layer, two mirror image elements may be reconfigured to have noncontrasting opposite surfaces. Moreover, the portions may be interchanged between layers to achieve color combinations that are otherwise unachievable.

A degree of dimensionality may be realized by having the layers housed in an overlying relationship. This allows the user to achieve shapes not corresponding to the outline of any element or group of elements by a subtractive process in which only portions of given elements from an underlying layer are exposed. Thus a new view and a higher level of variety (either abstract or literal) may be realized as layers are stripped away.

The present invention provides a useful educational and diagnostic tool wherein the user interacts in a manner that involves objective considerations such as right-/left perception and subjective factors involving psychological identification with various facial expressions. This may incorporate studies of passive behavior, as for example by creating facial expressions and asking subjects what they see, or non-passive behavior, as for example by asking subjects to create faces displaying certain expressions. A high degree of insight into the learning processes of various individuals may be achieved by observing how they initially approach the puzzle. A more theoretically oriented person might sort out the elements from all the layers by shape and size, thus forming a mental picture of the capabilities prior to actually constructing a pattern, while a more empirically inclined user might start experimenting with the elements to see which ones fit and which ones don't.

The present invention has appeal to users of all ages due to its simultaneous simplicity and complexity. While this aspect has self-evident benefits with respect to the use as an amusement device, the wide appeal has particular significance in connection with the use as a diagnostic tool. In particular, older subjects may consider a very simple puzzle an affront to their intelligence, while a diagnostician may prefer a simple puzzle to ensure that the subject can indeed solve it. The puzzle of the present invention can be easily "solved" in the sense that the pieces can be put together. At the same time, the endless variations in possible manners of solution provides a wealth of data for subjective interpretation and objective evaluation.

For a further understanding of the nature and advantages of the present invention, reference should be made to the remaining portions of the specification and to the attached drawings.

DESCRIPTION OF THE PREFERRED EMBODIMENTS

Figure 1:
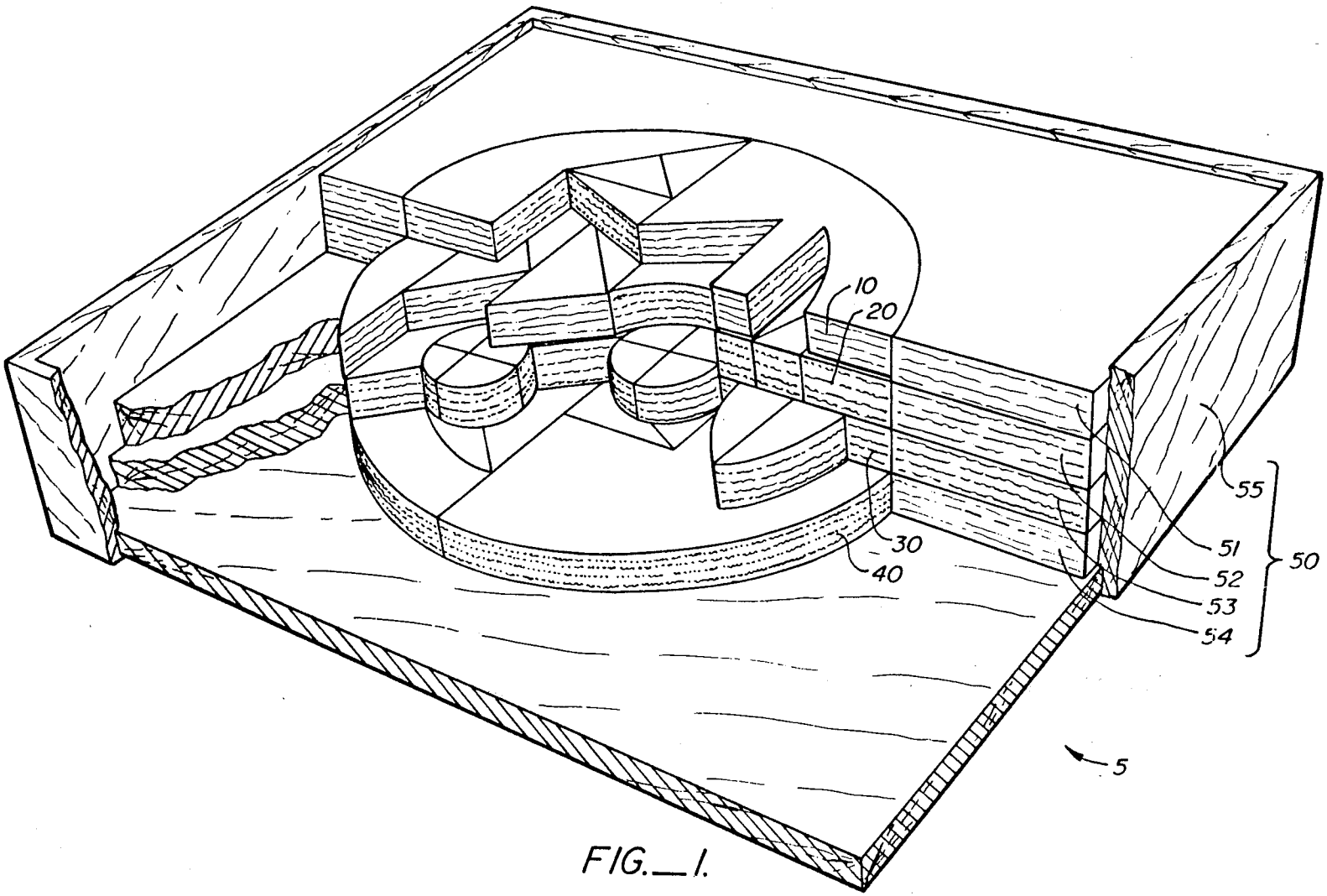
FIG. 1 is a cut-away perspective view of a embodiment of the present invention having four layers in overlying registration.

FIG. 1 is a cutaway perspective view of a puzzle toy 5 according to the present invention. Broadly, puzzle toy 5 includes four layers 10, 20, 30 and 40, and a housing 50. Each layer includes a plurality of individual elements that are combinable to fill a generally ovoid peripheral contour with all four layers having the same contour. Housing 50 maintains layers 10, 20, 30, and 40 in an overlying relationship with the individual elements thereof confined within the peripheral contour. Housing 50 is shown as comprising four individual frames 51, 52, 53 and 54, and an outer container 55. Each frame has a thickness corresponding to the layer thickness, an outer contour corresponding to the inner dimensions of container 55, and an inner contour complementary with the ovoid periphery of layers 10, 20, 30, and 40. Each frame further comprises bilaterally symmetric halves. In an alternate embodiment, shown in FIGS. 7A and 7B, housing 50 is replaced by a single frame having four openings to maintain layers 10, 20, 30, and 40 in a coplanar side-by-side relationship.

FIGS. 2A–2D are plan views showing the configuration of the elements in layers 10, 20, 30 and 40. As a threshold matter, it should be noted that the ovoid periphery of the layers is preferably defined by a semi-circle that is normally at the top of the user's field of view and a semi-ellipse that is normally at the bottom of the user's field of view. The minor axis of the semi-ellipse is commensurate with the diameter of the semi-circle. For ease of reference, the radius of the semi-circle will be considered to have a length of 4 units.

The elements in each layer have contrasting opposite surfaces so that individual elements within a layer may be reversed to form contrasting regions. Additionally, the surfaces in each layer should contrast with both surfaces of all other layers. Elements primarily in the semi-ellipse are capable of being reversed to define a contrasting nose and mouth while elements in the semi-circle may be reversed to define contrasting eyes, thus providing a stylized face.

An important property of the present invention is that elements or groups of elements from one layer may be interchanged with elements or groups of elements in other layers. The basic interchangeability of elements is achieved by providing elements having certain basic shapes and dimensional relationships so that certain areas corresponding to elements of one layer may be filled by elements of other layers having different individual contours. There are seven elemental configurations that find their way into two or more layers, as follows.

Type 1 is a chordal semi-segment defined by a semi-chord of length 2 units and a radius of $2\sqrt{2}$ units. There are two possible mirror image type 1 semi-segments, designated type 1a and type 1b. Type 1 semi-segments are found in layers 10, 20, 30, and 40.

Type 2 is a chordal semi-segment defined by a semi-chord of length $2\sqrt{2}$ units and a radius of 4 units. There are two possible mirror image type 2 semi-segments, designated type 2a and type 2b. Type 2 semi-segments are found in layers 20, 30, and 40.

Type 3 is a right isosceles triangle having equal sides of length 2 units (hypotenuse of length $2\sqrt{2}$ Units). Type 3 triangles are found in layers 20 and 40.

Type 4 is a right isosceles triangle having equal sides of length $\sqrt{2}$ units (hypotenuse of length 2 units). Type 4 triangles are in layers 10 and 20.

Type 5 is a right triangle having perpendicular sides of respective lengths 1 unit and 2 units (hypotenuse of length $\sqrt{5}$ units). There are two mirror image type 5 triangles, designated type 5a and type 5b. Type 5 triangles are found in layers 10, 20, and 40.

Type 6 is a trapezoid having mutually perpendicular sides of length 2 units and remaining sides of respective lengths 1 unit and $\sqrt{5}$ units, being combinable with a type 5 triangle to form a square having a side of length 2 units. There are two mirror image type 6 trapezoids, designated type 6a and type 6b. Type 6 trapezoids are found in layer 10.

Type 7 is a quarter circle having a radius of 1 unit.

In addition to the 7 types of regular elements are two types of irregular elements. The first, designated type 8, occurs in mirror image pairs of elements having quarter-elliptical peripheries with portions cut out to accommodate regular elements in the month and nose regions. Type 8 elements are found in layers 10, 20, 30, and 40, and are different from one layer to the next. The second type of irregular elements, designated type 9, form that portion of the semi-circle not filled by regular elements. Type 9 elements are found in layers 10, 30, and 40, and differ from layer to layer.

In the discussion that follows, the following system of reference numerals will be used. Each element is assigned a two-digit reference numeral, in some cases followed by the designator "a" or "b." The ten's digit is the layer number (1, 2, 3, or 4 for layer 10, 20, 30, or 40, respectively); the unit's digit is the element type number (an integer from 1 through 9). If the element is one of a mirror image pair designated "a" or "b," then the reference numeral also carries the designator "a" or "b." For example, a type 7 element in layer 30 is assigned the reference numeral 37, while a type 5a element in layer 40 is assigned the reference numeral 45*a*.

Figure 2A:
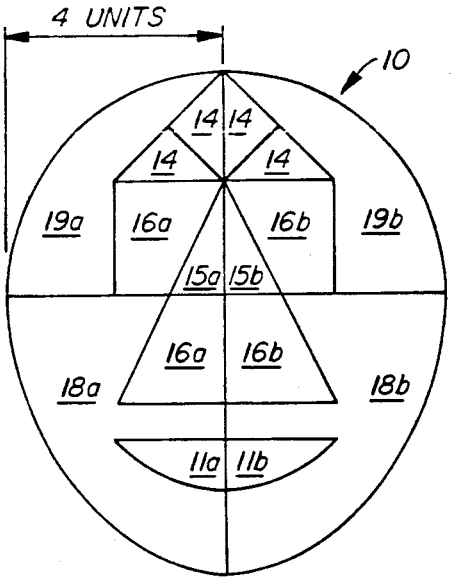
FIGS. 2A–D are plan views showing the configuration of the elements in the four layers.

Turning first to FIG. 2A, layer 10 includes a type 1a semi-segment 11*a*, a type 1b semi-segment 11*b*, four type 4 triangles 14, a type 5a triangle 15*a*, a type 5b triangle 15*b* two type 6a trapezoids 16*a*, and two type 6b trapezoids 16*b*. The lower semi-ellipse is defined by irregular elements 18*a* and 18*b*, which accommodate semi-segments 11*a* and 11*b* for the mouth and trapezoids 16*a* and 16*b* for the nose. The upper semi-circle is in part defined by irregular elements 19*a* and 19*b*.

Figure 2C:
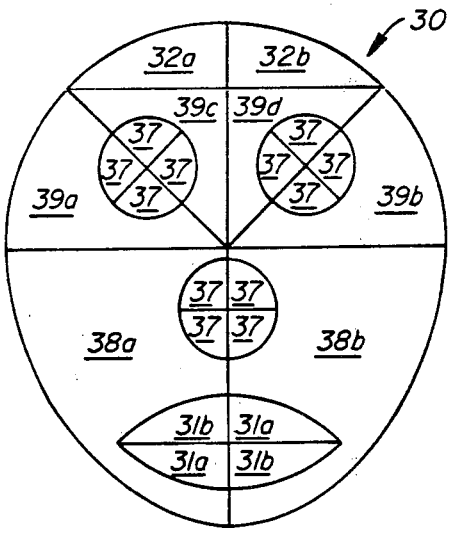
Figure 2B:
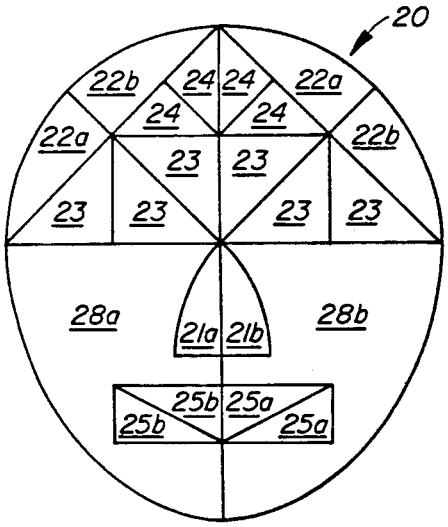

Turning next to FIG. 2B, layer 20 includes a type 1a semi-segment 21*a*, a type 1b semi-segment 21*b*, two type 2a semi-segments 22*a*, two type 2b semi-segments 22*b*, six type 3 triangles 23, four type 4 triangles 24, two type 5a triangles 25*a*, and two type 5b triangles 25*b*. The lower semi-ellipse is defined by irregular elements 18*a* and 18*b*, which accommodate triangles 25*a* and 25*b* for the mouth and semi-segments 21*a* and 21*b* for the nose.

Turning next to FIG. 2C, layer 30 includes two type 1a semi-segments 31*a*, two type 1b semi-segments 31*b*, a type 2a semi-segment 32*a*, a type 2b semi-segment 32*b*, and twelve type 7 quarter-circles 37. The lower semi-ellipse is defined by irregular elements 38*a* and 38*b* which accommodate semi-segments 31*a* and 31*b* for the mouth and four of quarter circles 37 for the nose. The upper semi-circle is in part defined by irregular elements 39*a* and 39*b*, each of which is 45° sector having a semi-circle removed for accommodating two quarter-circles 37, and irregular elements 39*c* and 39*d*, each of which is a right isosceles triangle having a semi-circle removed to accommodate two quarter-circles 37.

Figure 2D:
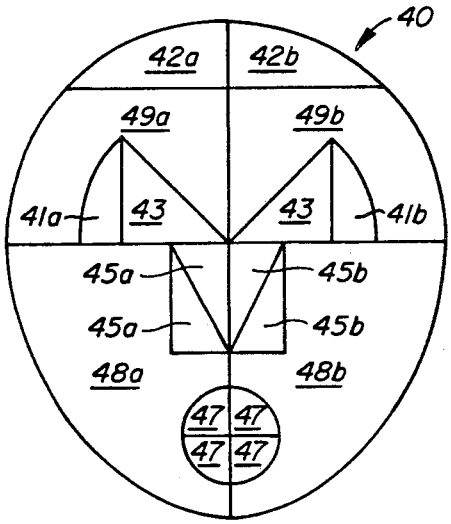

Turning next to FIG. 2D, layer 40 includes a type 1a semi-segment 41*a*, a type 1b semi-segment 41*b*, a type 2a semi-segments 42*a*, a type 2b semi-segment 42*b*, two type 3 triangles 43, two type 5a triangles 45*a*, two type 5b triangles 45*b*, and four type 7 quarter-circles 47. The lower semi-ellipse is defined by irregular elements 48*a* and 48*b* which accommodate triangles 45*a* and 45*b* for the nose and quarter-circles 47 for the mouth. The upper semi-circle is in part defined by irregular elements 49*a* and 49*b*.

Having described the geometrical configuration of the elements in the various layers, the rearrangement of the elements within a given layer to render various facial expressions and abstract configurations may be described. As indicated above, each layer has contrasting opposite surfaces, with layer 10 preferably having opposite green and blue surfaces, layer 20 having opposite orange and purple surfaces, layer 30 having opposite red and white surfaces, and layer 40 having opposite yellow and black surfaces. Frames 51–54 are preferably black on one side, white on the other. In order to better illustrate the appearance within the individual layers, elements in FIGS. 3A–C, 4A–C, 5A–C, and 6A–C are shaded for the sole purpose of suggesting contrast without specific reference to color. Where reference is made to a facial expression, it should be understood that such a characterization is highly subjective.

Figure 3A:
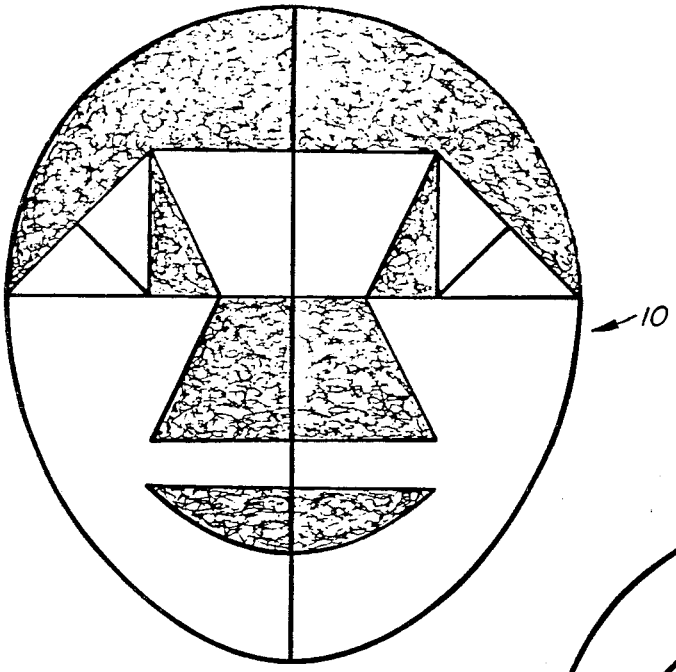
FIG. 3A is a plan view illustrating a first facial expression that may be formed from elements in the first layer.
Figure 3B:
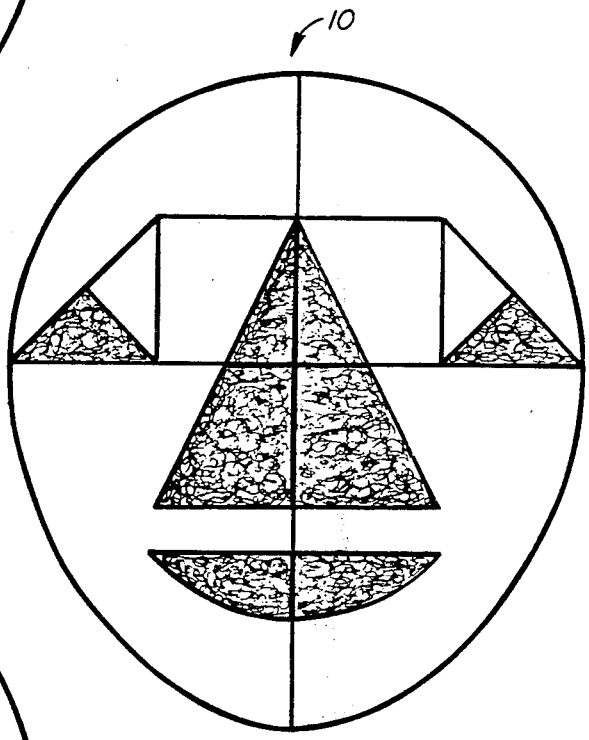
FIG. 3B is a plan view illustrating a second facial expression that may be formed from elements in the first layer.
Figure 3C:
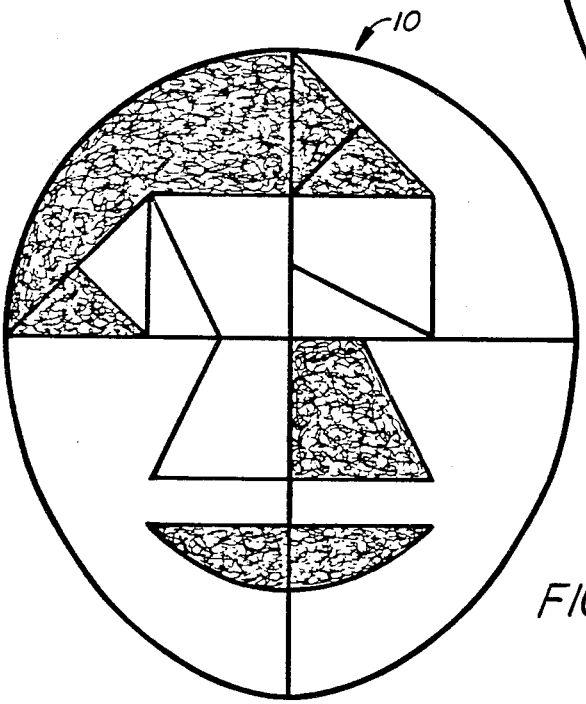
FIG. 3C is a plan view illustrating an abstract configuration that may be formed from elements in the first layer.

FIGS. 3A–3C show various configurations achieved by selectively reversing elements in layer 10. FIG. 3A shows semi-segments 11*a* and 11*b*, one each of trapezoids 16*a* and 16*b*, triangles 15*a* and 15*b*, and irregular elements 19*a* and 19*b* reversed and rearranged to depict a face having an impish expression. FIG. 3B shows semi-segments 11*a* and 11*b*, one each of trapezoids 16*a* and 16*b*, triangles 15*a* and 15*b*, and two of triangles 14 reversed and rearranged to depict a face having a placid expression. Notice that the nose extends upward into the upper semi-circle. FIG. 3C shows semi-segments 11*a* and 11*b*, one of trapezoids 16*b*, three of triangles 14, one of triangles 15*b*, and element 19*b* reversed with appropriate rearrangement to create an asymmetric abstract representation that may be said to suggest but not depict a face.

Figure 4A:
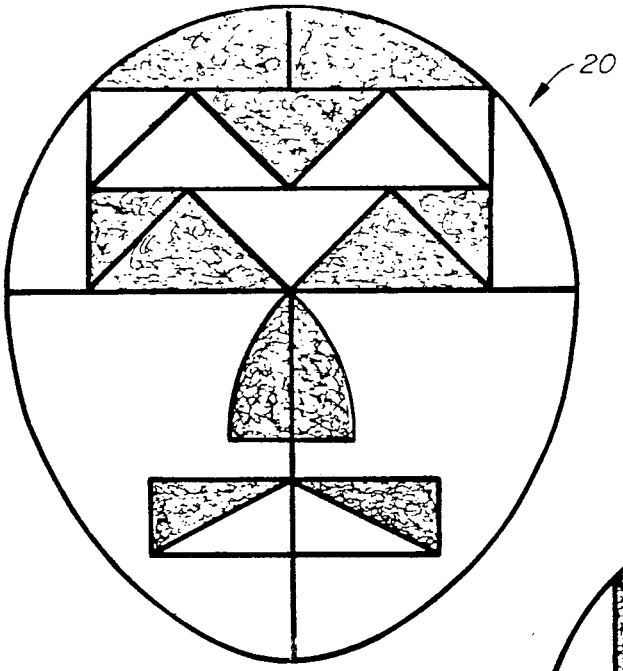
FIGS. 4A–C correspond to FIGS. 3A–C, but for the second layer.
Figure 4B:
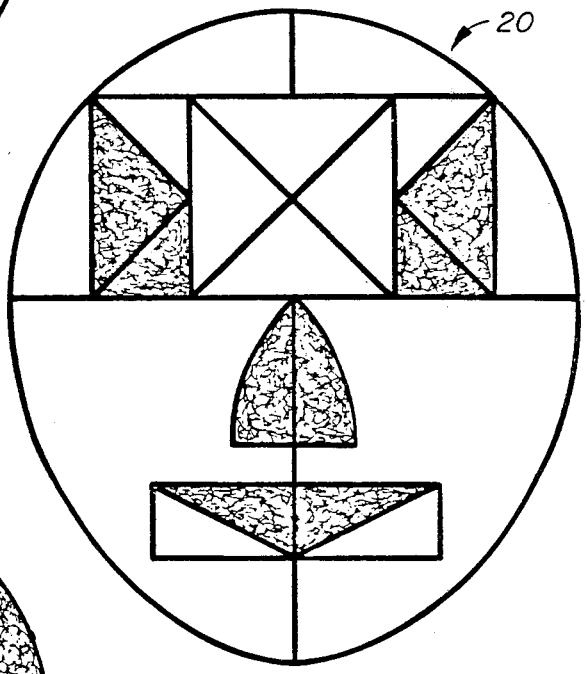
Figure 4C:
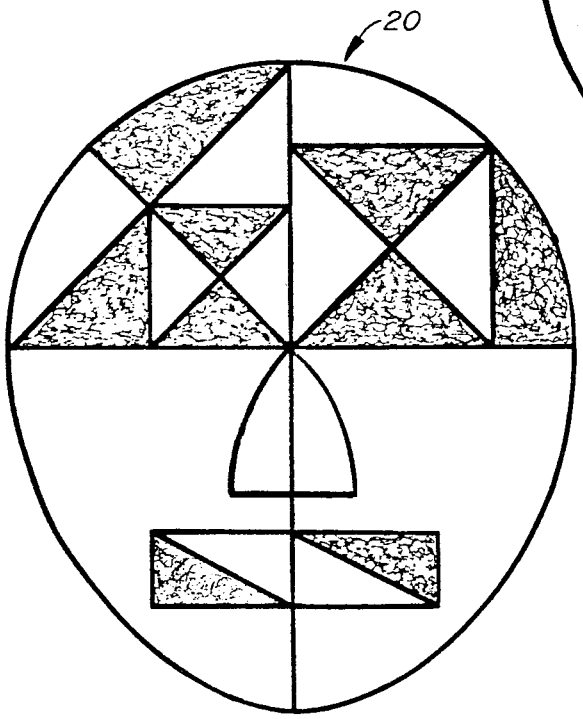

FIGS. 4A–4C show various configurations achieved by selectively reversing elements in layer 20. FIG. 4A depicts an angry expression while FIG. 4B shows other parts reversed and rearranged to depict an eager expression. As described in connection with FIG. 2B, the upper semi-circle of layer 20 contains many right triangles, thus permitting a considerable amount of rearrangement of elements. In addition to permitting a wide range of facial variation in the eye regions, interesting geometrical patterns such as that depicted in 4C may be achieved.

Figure 5A:
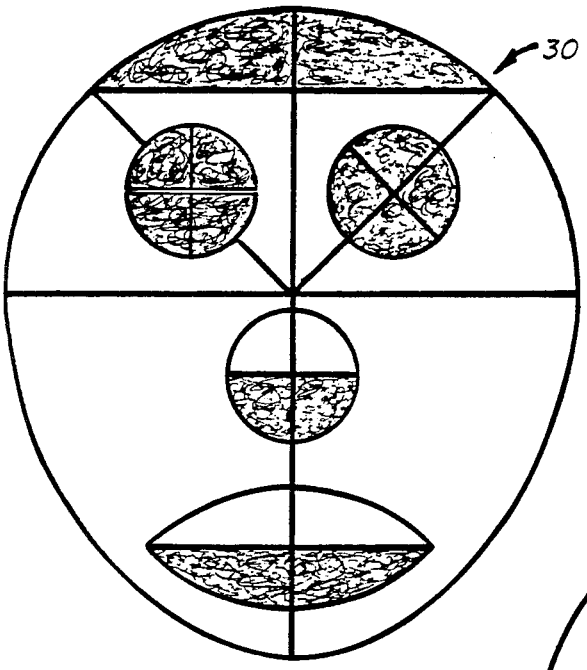
FIGS. 5A–C correspond to FIGS. 3A–C, but for the third layer.
Figure 5B:
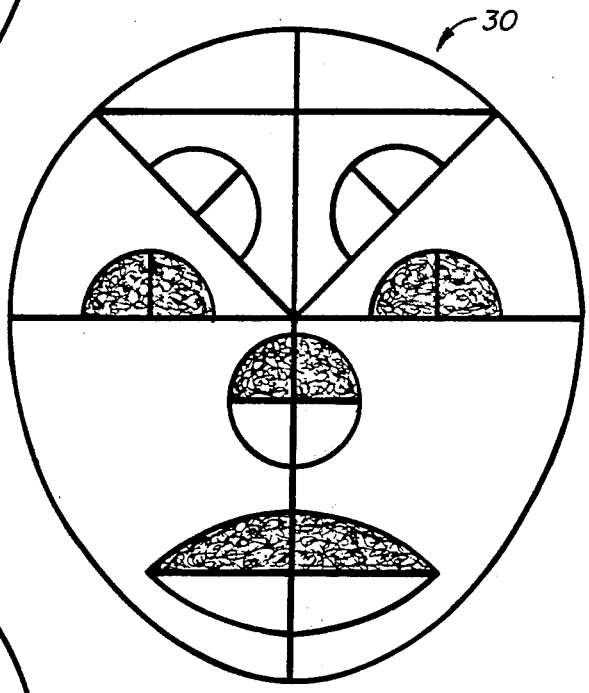
Figure 5C:
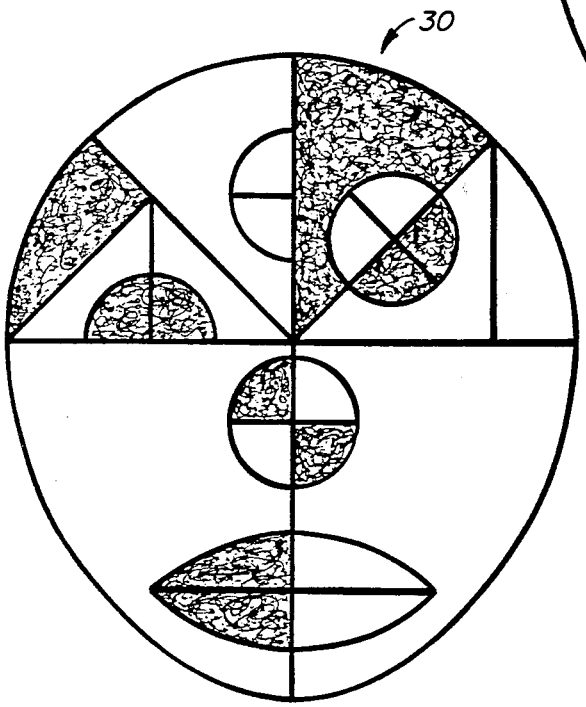

FIGS. 5A–5C show various configurations achieved by selectively reversing elements in layer 30. FIG. 5A shows elements selectively reversed to depict a happy expression while FIG. 5B shows a sad expression. The upper semi-circle of layer 30 may be broken down into four 45° sectors. The abstract configuration of FIG. 5C exploits the possibilities by having contrasting treatment in adjacent sectors. The result may be loosely referred to as a "cubist" design in which eye regions are selectively fragmented and displaced from one another.

Figure 6A:
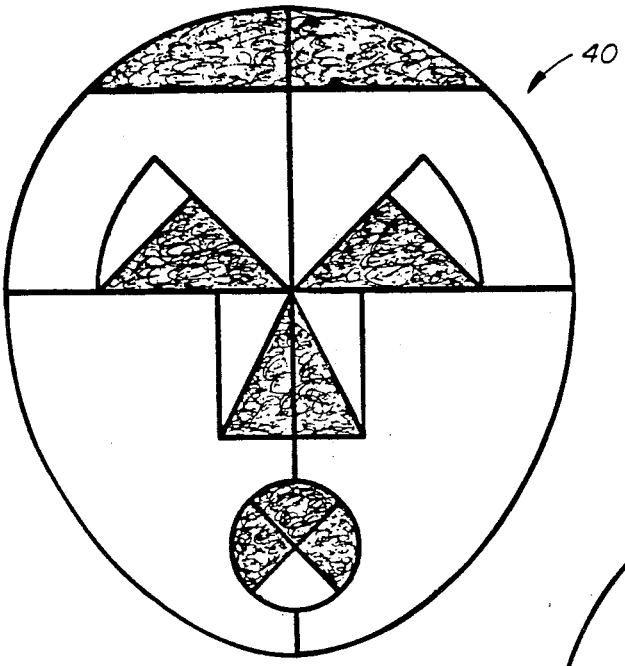
FIGS. 6A–C correspond to FIGS. 3A–C, but for the fourth layer.
Figure 6B:
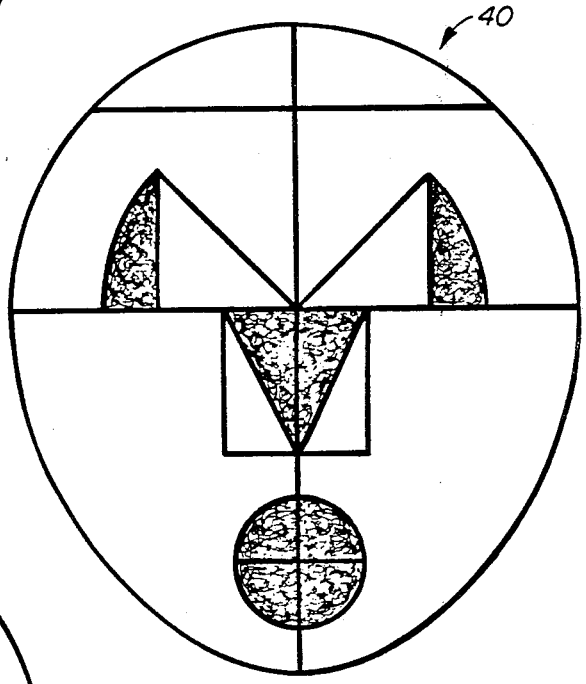
Figure 6C:
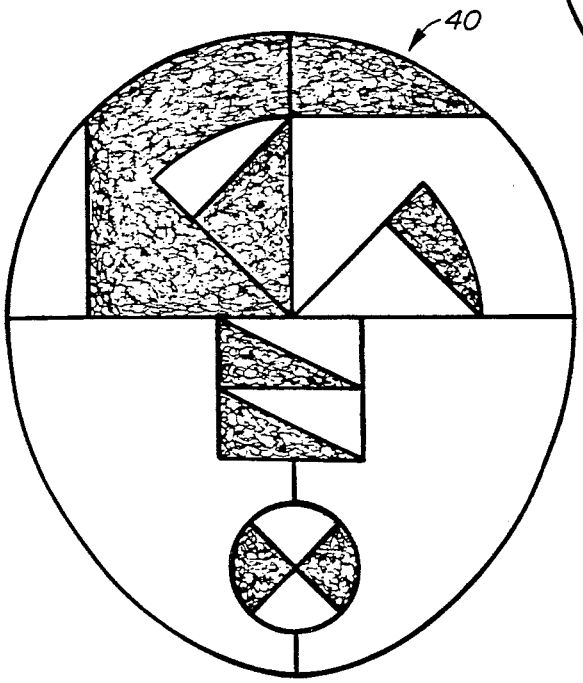

FIGS. 6A–6C show various configurations achieved by selectively reversing elements in layer 40. FIG. 6A shows a pouting expression while FIG. 6B shows a questioning expression. The nature of layer 40 is that the nose and mouth regions each may be defined by four elements so that geometrical patterns that do not resemble the facial features may be achieved. In the abstract configuration in FIG. 6C, the selective reversal of triangles 45*a* results in a repetitive pattern while a selective reversal of opposite quarter-circles 47 accompanied by a 45° rotation produces a symmetric geometric pattern.

In spite of the wide variety of configurations that may be achieved by rearranging elements within any one layer, much of the true potential and scope of the present invention is realized when elements are interchanged between layers. At this point, color balance and composition become more important and additional aspects of geometric interchangability come into play. At a first level, correspondingly shaped elements are present in different layers, as described above. At a second level, each layer includes regions that may be filled by a multiplicity of elements from one or more other layers that have different peripheral configurations than the elements originally in that region. For example, a type 5a triangle and a type 6a trapezoid, taken together form a square having a side of length 2 units, which square may also be filled by two type 5a triangles and two type 5b triangles, or alternately by two type 3 triangles. Similarly, areas corresponding to some of the irregularly shaped pieces may be filled by a multiplicity of regular elements from other layers. For example, the area corresponding to element 19*a* in layer 10 may be filled by semi-segments 32*a* and 32*b* from layer 30 and one of triangles 23 from layer 20. These are but a few examples of the virtually limitless variety of configurations that will be apparent to most users.

Figure 7A:
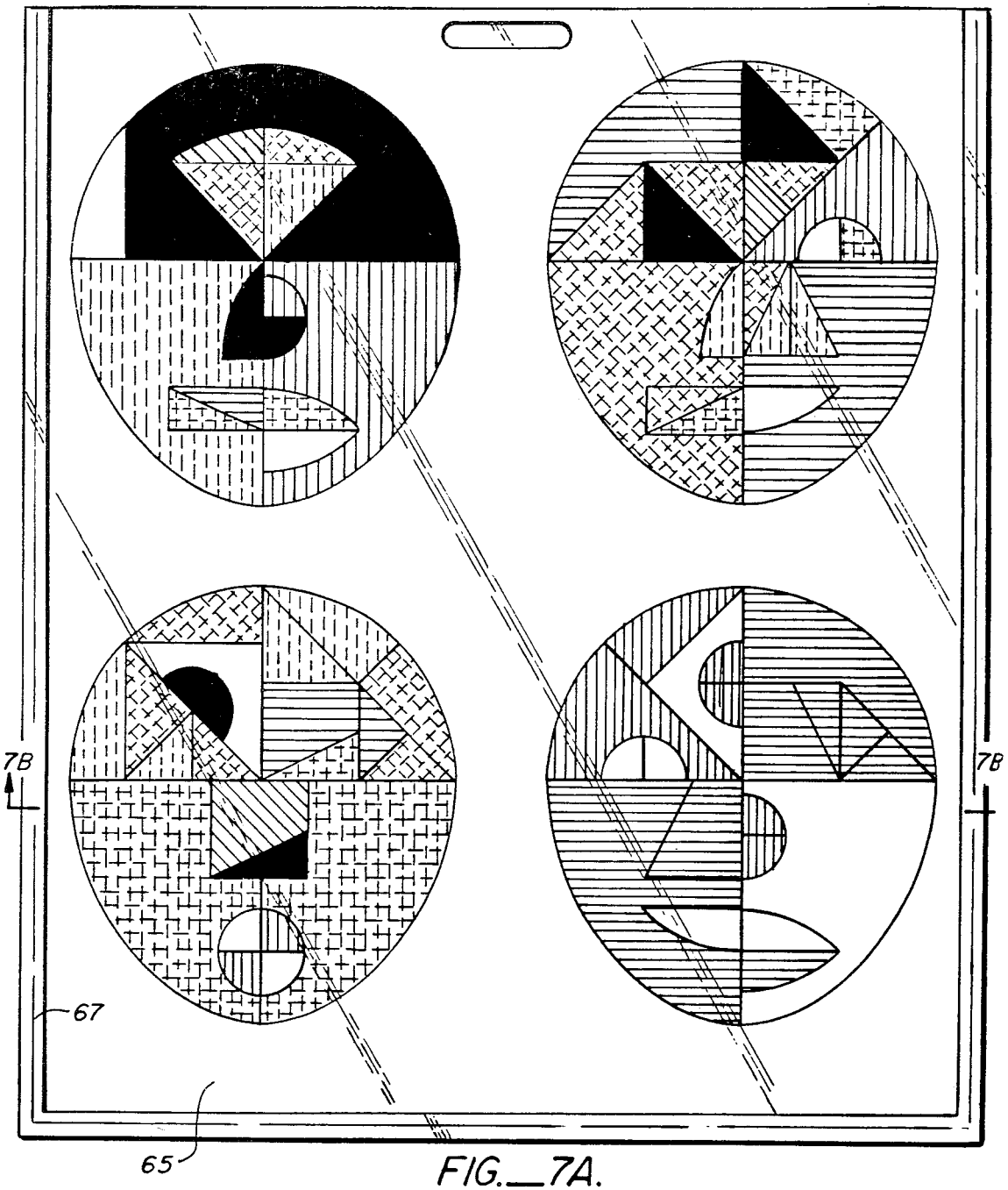
FIG. 7A is a plan view showing the elements of all four layers rearranged to form four abstract configurations which are displayed in a frame.

FIG. 7A illustrates the result of engaging in widespread rearrangement of elements among the various layers, to the point where the original specification of layers themselves become meaningless. Color shading is shown but numerals are omitted for clarity. It should be noted that all the elements are ultimately combinable to form four hybrid layers, although there are a small number of instances where a user will start combining elements, and by the time three full layers have been formed, a fourth layer cannot be formed from the remaining elements. Minor rearrangement will invariably permit all the layers to be formed.

Figure 7B:
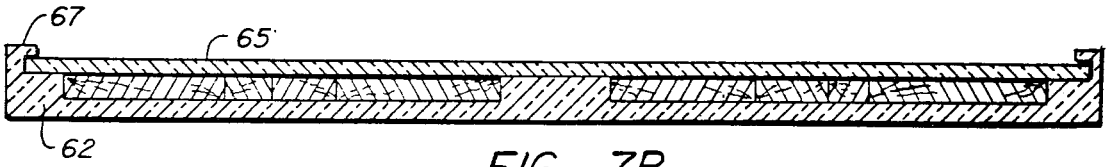
FIG. 7B is a sectional view through line 7B—7B of FIG. 7A.

Additionally, FIGS. 7A and 7B illustrate an alternate embodiment of a housing 60 for maintaining the assembled elements in a coplanar relationship. Housing 60 comprises a base 62 having four recessed regions, each commensurate with the basic ovoid contour, and a window 65 which overlies base 62 and the elements therein. Window 65 is removably held to base 62 by any suitable means such as peripheral flanges 67 on base 60. Base 60 and window 62 are preferably transparent, at least in the regions facing the recesses. Provision may be made for reversibly hanging housing 60 on a wall.

Figure 8:
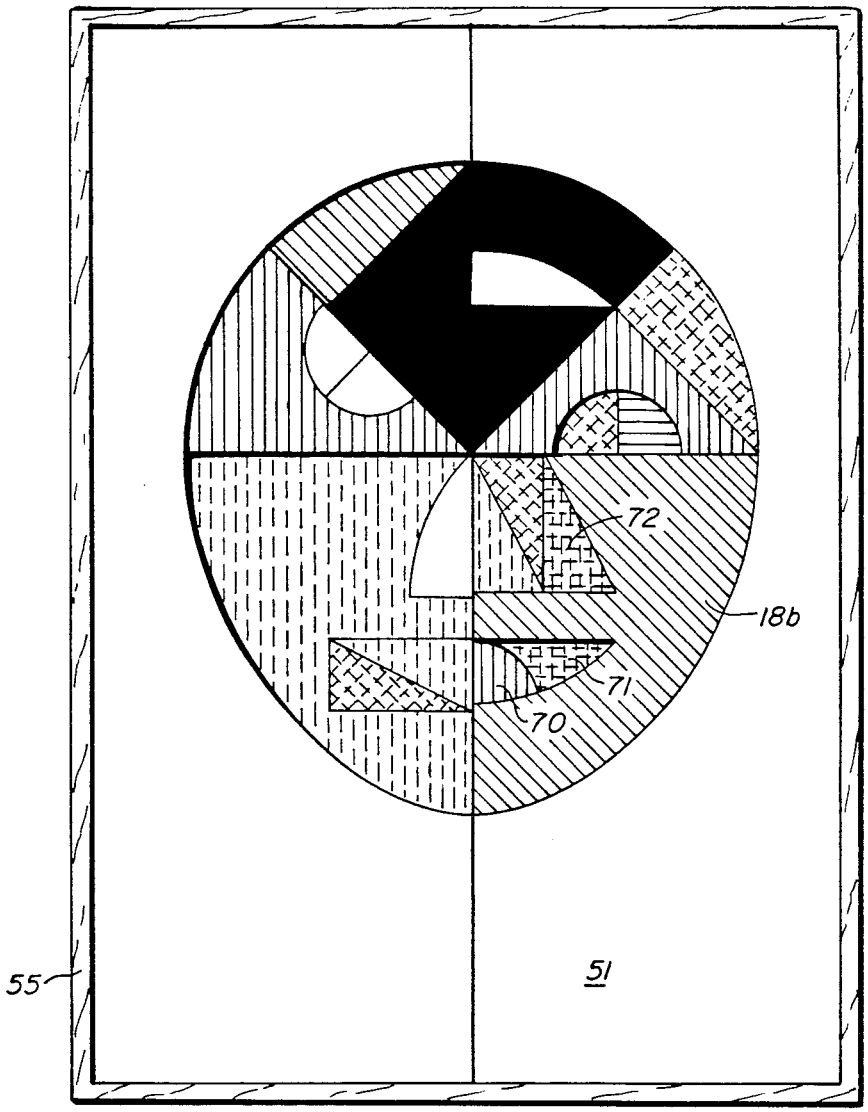
FIG. 8 illustrates a configuration defined by two overlapping layers.

In the embodiment described in FIG. 1, the layers are held in an overlying registration. This provides an additional level of complexity to be achieved since partial layers may be superimposed to reveal shape and color combinations that cannot be achieved with individual elements. FIG. 8 illustrates one such possibility wherein element 18*b* overlies the corresponding quarter-elliptical region of an abstract configuration producing areas 70, 71, and 72, none of which could be achieved within a single layer. In particular, areas 70 and 71 correspond to none of the regular shapes, while area 72 is in the shape of a type 5 triangle but of a color in which type 5 triangles are unavailable.

FIGS. 9A–B and 10A–B illustrate two alternate embodiments wherein at least some of the elements of puzzle toy 5 are of composite construction, with each element including oppositely facing portions of contrasting color that snap together in order to provide the contrasting oppositely facing surfaces.

Figure 9A:
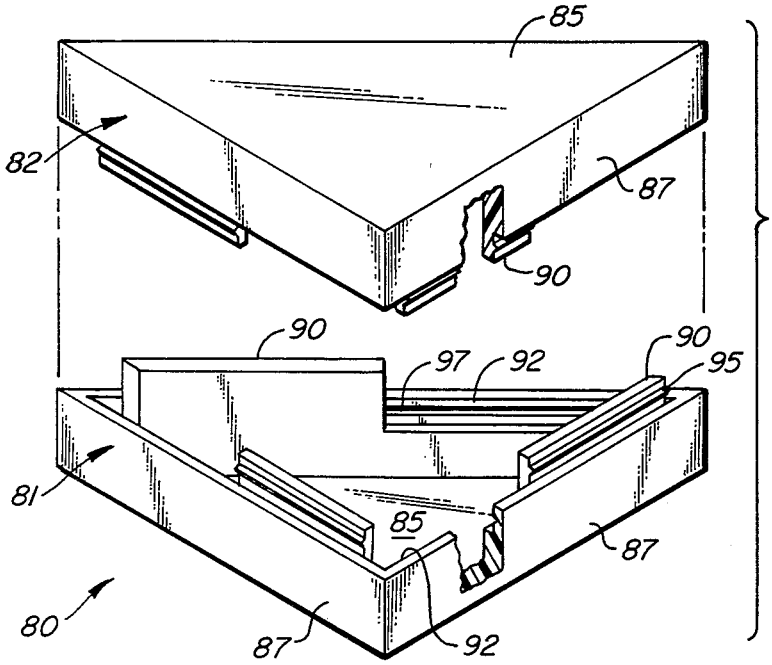
FIG. 9A is an exploded isometric view of a first embodiment of a composite element.
Figure 9B:
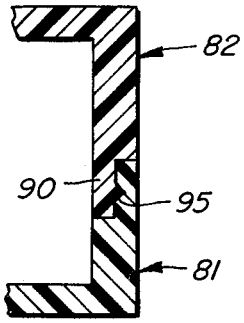
FIG. 9B is a fragmentary sectional view of the assembled element of FIG. 9A.

FIG. 9A is an exploded isometric view of a first embodiment of a composite element 80, shown for definiteness as a type 5 triangle. FIG. 9B is a fragmentary sectional view of the assembled element. Element 80 includes first and second oppositely facing element portions 81 and 82, each of which is molded in a different colored plastic (for example, orange and purple if element 80 is to be a number of layer 20). Each element portion includes a face portion 85 and peripheral flanges 87. Flanges 87 carry a plurality of projecting lug members 90, and are formed with lug-receiving recesses 92, such that projecting lug members of element portion 81 are received by corresponding lug-receiving recesses of element portion 82, and vice versa. Lug members 90 each carry a bead 95 while lug receiving recesses 92 are each formed with a correspondingly configured groove 97 so that element portions 81 and 82 may be snapped together for assembly.

Figure 10A:
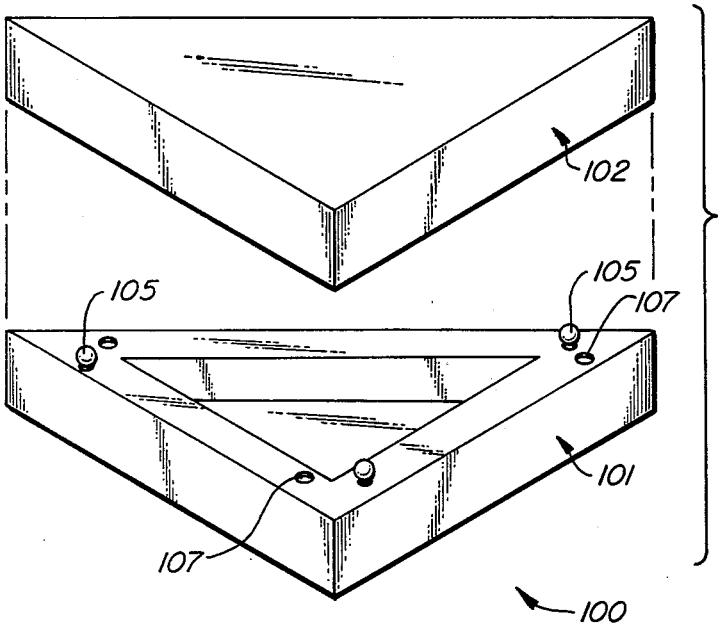
FIG. 10A is an exploded isometric view of a second embodiment of a composite element.
Figure 10B:
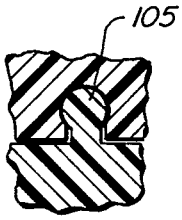
FIG. 10B is a fragmentary sectional view of the assembled element of FIG. 10A.

FIG. 10A is an exploded isometric view of a second embodiment of a composite element 100, again shown for definiteness as a type 4 triangle. FIG. 10B is a fragmentary sectional view of the assembled element. Element 100 includes first and second oppositely facing element portions molded from colored plastic as in the case of element 80 of FIG. 9A. Element 100 differs from element 80 in the fastening mechanism that holds the two element portions together. More particularly, each of element portions 101 and 102 carries one or more upstanding ball members 105, and is formed with one or more ball receiving sockets 107 to provide a snap-together fit of element portions 101 and 102.

The snap-together construction has economic significance in that the construction of puzzle toy 5 from molded plastic elements may be accomplished without the necessity of any bonding steps, thus resulting in a cost saving. The corresponding element portions need only be snapped together, and the puzzle may even be sold as a kit where the user assumes responsibility for snapping the appropriate element portions together.

However, the use of a snap-together construction provides a surprising additional benefit if the snap-together construction is releasible so that a given element, once assembled, may be disassembled. According to this aspect of the invention, the fastening portions are configured so that two elements having mirror image symmetry with respect to one another may be disassembled and re-assembled to form two new mirror image elements, each of which has non-contrasting oppositely facing surfaces. Thus, two triangles such as triangle 80 could be disassembled, and the orange element portions fitted together and the purple element portions fitted together to provide an all purple element and an all orange element. Carrying this to its extreme, given that each layer has bilateral symmetry with respect to its constituent elements, it is possible to disassemble the elements of a layer, and re-assemble them so that half of the elements of the layer are all of one color and the other half of the elements are of the contrasting. While a user is unlikely to resort to such an extreme reconfiguration of the elements, the reconfiguration capability may be especially useful in the case of the irregularly shaped type 8 and type 9 elements. Referring again to FIGS. 3A–C, 4A–C, 5A–C and 6A–C, it will be noted that without such reconfigurations it is impossible to have symmetrically disposed type 8 or type 9 pieces with contrasting surfaces showing. However, certain abstract designs may be enhanced by having contrasting mirror image type 8 or 9 elements, which can be achieved by disassembling the two type 8 or type 9 elements for a given layer and reassembling them as described above.

It is also possible to create new elements having different pairs of contrasting surfaces. For example, a type 4 triangle from layer 20 (orange and purple) and a type 4 triangle from layer 10 (green and blue) may be disassembled and re-assembled to yield a new pair of elements, one having orange and blue opposing surfaces and another having green and purple opposing surfaces.

It is also possible, utilizing the composite construction described above, to form a more complex element having a first surface of one color and a second surface having portions of two colors. This can be achieved by utilizing portions of type 4 triangles for one surface and a type 3 triangle (twice the size) on the other.

It should be noted that the composite structure does not lead to an increase in the number of different molds required. For example, the irregularly shaped elements require only two molds, since the right hand "top" portion and the left hand "bottom" portion may be identical in all respects except color, and similarly for the right hand "bottom" portion and the left hand "top" portion. The elements shown in FIGS. 9A and 10A show a further economy that may be achieved in the case of elements that have bilateral symmetry within themselves (quarter circles, right isoceles triangles). By providing each element portion with male and female fastening members, symmetrically disposed to each other, the element portion is rendered capable of mating with an identically configured element portion, so that only one mold is required.

In summary, it can be seen that the puzzle toy of the present invention is surprisingly versatile and amusing, but with a range of applicability that goes far beyond mere amusement to provide a useful educational and diagnostic tool. While the above provides a full and complete disclosure of the preferred embodiments of this invention, various modifications, alternate constructions, and equivalents may be employed without departing from the true spirit and scope of the invention. For example, other shapes having the desired interchangability features might be used. Additionally, frames 51–54, rather than being black and white, could be colored in the same manner as their corresponding layers. Moreover, individual housings constructed like housing 60 could be provided for individual display of configurations achieved. Indeed, even a single layer of the puzzle toy provides a large number of the benefits of the multiple layer puzzle toy, so that the puzzle toy may be marketed on an individual layer basis, thus providing the user with the option of buying one layer at a time for economy reasons. Therefore, the above description and illustrations should not be construed as limiting the scope of the invention which is defined by the appended claims.

I claim:

1. A puzzle toy comprising:

a plurality of layers, each layer having substantially the same generally ovoid peripheral contour;

each of said layers consisting of a plurality of elements combinable to fill the entire area within said peripheral contour;

the elements of each layer having first and second oppositely facing contrasting surfaces with the elements being reversible to fit in corresponding portions of said area to provide contrast in the appearance of said layer when said area is filled by said combined elements;

said elements within a layer being capable of filling said area while forming a contrasting nose, mouth, and eyes of a stylized face, there being a sufficient multiplicity of elements in the region of said nose, mouth, and eyes to allow at least one of the nose, mouth, and eyes to be changed with respect to the position or surface of the elements forming them that is presented to the viewer to permit variations in facial expression within said filled area;

there being a sufficient multiplicity of elements within a given layer to permit the rearrangement and reversal of elements within said layer to form, while filling said area, an abstract asymmetrical configuration reminiscent but not directly representative of a stylized face;

a predetermined portion of the area filled by a first group of said elements of a first of said layers being of a shape adapted to be filled by a second group of said elements of a second of said layers with the individual elements of said second group being of different periphery than the individual elements of said first group to provide additional variety in the range of possible facial expressions and the level of abstraction;

each of said elements being of composite construction including separably fastened oppositely facing contrasting portions to provide said contrasting surfaces, at least a first element and a second element of at least one of said layers having sufficient symmetry with respect to each other that said first and second elements may be disassembled and their portions reassembled to provide two new elements, each of which has non-contrasting oppositely facing surfaces.

2. A kit for a puzzle toy having a plurality of layers, each layer having substantially the same generally ovoid peripheral contour, each of said layers consisting of a plurality of elements combinable to fill the entire area within said peripheral contour, said kit comprising:

a plurality of element portions, said element portions being combinable in pairs to form said elements in a manner that said elements present first and second oppositely facing contrasting surfaces with the elements of each layer being reversible to fit in corresponding portions of said area to provide contrast in the appearance of said layer when said area is filled by said combined elements;

said elements within a layer being capable of filling said area while forming a contrasting nose, mouth, and eyes of a stylized face, there being a sufficient multiplicity of elements in the region of said nose, mouth, and eyes to allow at least one of the nose, mouth, and eyes to be changed with respect to the position or surface of the elements forming them that is presented to the viewer to permit variations in facial expression within said filled area;

there being a sufficient multiplicity of elements within a given layer to permit the rearrangement and reversal of elements within said layer to form, while filling said area, an abstract asymmetrical configuration reminiscent but not directly representative of a stylized face;

a predetermined portion of the area filled by a first group of said elements of a first of said layers being of a shape adapted to be filled by a second group of said elements of a second of said layers with the individual elements of said second group being of different periphery than the individual elements of said first group to provide additional variety in the range of possible facial expressions and the level of abstraction;

at least a first element and a second element of at least one of said layers having sufficient symmetry with respect to each other that the element portions that form said first and second elements may be alternately assembled to provide two new elements, each of which has non-contrasting oppositely facing surfaces.

3. The invention of claim 1 or 2 wherein the elements in each layer may be arranged to fill said area, all with the same one of said first and second surfaces showing such that, within its layer, each element is paired with a corresponding element located symmetrically with respect to a medial line.

4. The invention of claim 3 wherein the elements in each layer may be subdivided into groups forming paired quarter circles, elements within which may be reversed to form contrasting eyes, and paired quarter elliptical portions, elements within which may be reversed to form contrasting mouth and nose.

5. The invention of claim 4 wherein said nose has the shape of a figure that is one of the group consisting of a rectangle, a triangle, a trapezoid, a circle, a semicircle, and a pair of abutting semichordal segments, and wherein said mouth has the shape of a figure that is one of the group consisting of a rectangle, a circle, a chordal segment, and a pair of abutting chordal segments, and wherein said mouth and said nose in a given layer are of different shapes.

6. The invention of claim 1 or 2, and further comprising means defining a housing having an interior peripheral contour adapted to maintain said elements of said layers within said generally ovoid peripheral contour.

7. The invention of claim 6 wherein said housing is defined by a corresponding plurality of layers and a container for holding said layers in overlying registration.

8. The invention of claim 1 or 2 wherein said first and second contrasting surfaces of said first layer are contrasting with respect to said first and second contrasting surfaces of said second layer.

9. The invention of claim 1 or 2 wherein said first layer includes an element having the same periphery as an element in said second layer.

10. The invention of claim 1 or 2 wherein said first layer includes first and second elements having different peripheries that are the same as the respective peripheries of first and second elements in said second layer.

11. The invention of claim 1 or 2 wherein said element portions are molded from plastic with corresponding portions being of snap-together construction.

12. A puzzle toy comprising:

a plurality of elements combinable in a layer to fill the entire area within a generally ovoid peripheral contour without extending beyond said contour;

said elements having first and second oppositely facing contrasting surfaces with the elements being reversible to fit in corresponding portions of said area to provide contrast in the appearance of said area when said area is filled by said combined elements;

said elements being capable of filling said area while forming a contrasting nose, mouth, and eyes of a stylized face, the shape of said nose, mouth, and eyes being determined by the shapes of the elements forming them;

there being a sufficient multiplicity of elements in the region of said nose, mouth, and eyes to allow at least one of the nose, mouth, and eyes to be changed with respect to the position or surface of the elements forming them that is presented to the viewer to permit variations in facial expression within said filled area;

there being a multiplicity of elements to permit the rearrangement and reversal of elements to form, while filling said area, an abstract asymmetrical configuration reminiscent but not directly representative of a stylized face;

a predetermined portion of the area filled by a first group of said elements being of a shape adapted to be filled by a second group of said elements with the individual elements of said second group being of different periphery than the individual elements of said first group to provide additional variety in the range of possible facial expressions and the level of abstraction.

13. A puzzle toy comprising:

a plurality of elements combinable in a layer to fill the entire area within a generally ovoid peripheral contour;

said elements having first and second oppositely facing contrasting surfaces with the elements being reversible to fit in corresponding portions of said area to provide contrast in the appearance of said layer when said area is filled by said combined elements;

said elements being capable of filling said area while forming a contrasting nose, mouth, and eyes of a stylized face, there being a sufficient multiplicity of elements in the region of said nose, mouth, and eyes to allow at least one of the nose, mouth, and eyes to be changed with respect to the position or surface of the elements forming them that is presented to the viewer to permit variations in facial expression within said filled area;

there being a sufficient multiplicity of elements to permit the rearrangement and reversal of elements to form, while filling said area, an abstract asymmetrical configuration reminiscent but not directly representative of a stylized face;

a predetermined portion of the area filled by a first group of said elements being of a shape adapted to be filled by a second group of said elements with the individual elements of said second group being of different periphery than the individual elements of said first group to provide additional variety in the range of possible facial expressions and the level of abstraction; and each of said elements being of composite construction including separably fastened oppositely facing contrasting portions to provide said contrasting surfaces, at least a first element and a second element having sufficient symmetry with respect to each other that said first and second elements may be disassembled and their portions reassembled to provide two new elements, each of which has non-contrasting oppositely facing surfaces.

14. A kit for a puzzle toy having a plurality of elements combinable in a layer to fill the entire area within a generally ovoid peripheral contour, said kit comprising:

a plurality of element portions, said element portions being detachably attachable in pairs to form said elements in a manner that said elements present first and second oppositely facing contrasting surfaces with the elements being reversible to fit in corresponding portions of said area to provide contrast in the appearance of said layer when said area is filled by said combined elements;

said elements being capable of filling said area while forming a contrasting nose, mouth, and eyes of a stylized face, there being a sufficient multiplicity of elements in the region of said nose, mouth, and eyes to allow at least one of the nose, mouth, and eyes to be changed with respect to the position or surface of the elements forming them that is presented to the viewer to permit variations in facial expression within said filled area;

there being a sufficient multiplicity of elements to permit the rearrangement and reversal of elements to form, while filling said area, an abstract symmetrical configuration reminiscent but not directly representative of a stylized face;

a predetermined portion of the area filled by a first group of said elements being of a shape adapted to be filled by a second group of said elements with the individual elements of said second group being of different periphery than the individual elements of said first group to provide additional variety in the range of possible facial expressions and the level of abstraction;

at least a first element and a second element having sufficient symmetry with respect to each other that the element portions detachably attachable to form said first and second elements may be alternately assembled to provide two new elements having non-contrasting oppositely facing surfaces.

15. The invention of claim 12 or 13 or 14 wherein said elements may be arranged to fill said area, all with the same one of said first and second surfaces showing such that each element is paired with a corresponding element located symmetrically with respect to a medial line.

16. The invention of claim 15 wherein said elements in each layer may be subdivided into groups forming paired quarter circles, elements within which may be reversed to form contrasting eyes, and paired quarter elliptical portions, elements within which may be reversed to form contrasting mouth and nose.

17. The invention of claim 16 wherein said nose has the shape of a figure that is one of the group consisting of a rectangle, a triangle, a trapezoid, a circle, a semicircle, and a pair of abutting semichordal segments, and wherein said mouth has the shape of a figure that is one of the group consisting of a rectangle, a circle, a chordal segment, and a pair of abutting chordal segments, and wherein said mouth and said nose are of different shapes.

18. The invention of claim 12 or 13 or 14, and further comprising means defining a housing having an interior peripheral contour adapted to maintain said elements within said generally ovoid peripheral contour.

19. The invention of claim 13 or 14 wherein said element portions are molded from plastic with corresponding portions being of snap-together construction.

20. The invention of claim 12 or 13 or 14 wherein said elements have the geometrical configurations shown in FIG. 2A.

21. The invention of claim 12 or 13 or 14 wherein said elements have the geometrical configurations shown in FIG. 2B.

22. The invention of claim 12 or 13 or 14 wherein said elements have the geometrical configurations shown in FIG. 2C.

23. The invention of claim 12 or 13 or 14 wherein said elements have the geometrical configurations shown in FIG. 2D.

* * * * *